US009289053B2

(12) United States Patent
Menken et al.

(10) Patent No.: US 9,289,053 B2
(45) Date of Patent: Mar. 22, 2016

(54) BRUSH RING FOR SWEEPING ROLLERS

(75) Inventors: Ulrich Menken, Bad Camberg (DE); Werner Weil, Bad Camberg-Erbach (DE); Jan Winkler, Bad Camberg (DE)

(73) Assignee: WEBER BURSTENSYSTEME GMBH, Bad Camberg (DE)

( * ) Notice: Subject to any disclaimer, the term of this patent is extended or adjusted under 35 U.S.C. 154(b) by 570 days.

(21) Appl. No.: 13/816,082

(22) PCT Filed: Aug. 1, 2011

(86) PCT No.: PCT/EP2011/003841

§ 371 (c)(1), (2), (4) Date: Aug. 14, 2013

(87) PCT Pub. No.: WO2012/019723

PCT Pub. Date: Feb. 16, 2012

(65) Prior Publication Data

US 2013/0318733 A1 Dec. 5, 2013

(30) Foreign Application Priority Data

Aug. 9, 2010 (EP) ..... 10008278
Feb. 23, 2011 (DE) ..... 10 2011 012 157

(51) Int. Cl.
*A46B 13/00* (2006.01)
*A46B 9/08* (2006.01)

(52) U.S. Cl.
CPC ..... *A46B 13/003* (2013.01); *A46B 9/08* (2013.01)

(58) Field of Classification Search
CPC ..... A46B 13/003; A46B 13/001; A46B 7/10; A46B 2200/202; A46B 7/04; A46B 9/08; A46B 3/12; A46B 9/12
See application file for complete search history.

(56) References Cited

U.S. PATENT DOCUMENTS

| | | | | |
|---|---|---|---|---|
| 3,084,367 A * | 4/1963 | Geil | A46B 13/003 15/181 |
| 3,274,634 A | 9/1966 | Godfrey | |
| 4,998,316 A | 3/1991 | Maltarp | |
| 5,784,748 A * | 7/1998 | Belanger | A46B 13/003 15/230.14 |
| 6,205,609 B1 * | 3/2001 | Sajakorpi | A46B 13/003 15/181 |

FOREIGN PATENT DOCUMENTS

| | | |
|---|---|---|
| EP | 1647201 B1 | 9/2007 |
| WO | 9809551 A1 | 3/1998 |
| WO | 9960885 A1 | 12/1999 |
| WO | 2005034678 A1 | 4/2005 |

OTHER PUBLICATIONS

International Preliminary Report on Patentability and Written Opinion of the International Searching Authority for PCT/EP2011/003841; The International Bureau of WIPO; Feb. 12, 2013.

* cited by examiner

*Primary Examiner* — Robert Scruggs
(74) *Attorney, Agent, or Firm* — Christopher C. Dremann, P.C.; Christopher C. Dremann

(57) ABSTRACT

The invention relates to a brush ring having a ring-like frame part, to which bristles protruding radially outwardly can be fastened and which can be slid axially onto a shaft in order to form a sweeping roller and which can be fastened on the shaft in a rotationally secured manner by means of at least one catch device protruding radially inwardly, wherein the frame part, viewed in the circumferential direction, has ring sections arranged at an offset from each other in the axial direction and connecting elements formed in the axial direction, the connecting elements being arranged symmetrically to each other with respect to a center point axis extending through the catch device and the ring center point.

14 Claims, 9 Drawing Sheets

BRUSH RING FOR SWEEPING ROLLERS

CROSS REFERENCE TO RELATED APPLICATION

This United States non-provisional patent application is the national stage of International Application No. PCT/EP2011/003841 filed Aug. 1, 2011, which claims the benefit of priority of European Application No. 10 008 278.3 filed Aug. 9, 2010, and German Application No. 10 2011 012 157.9 filed Feb. 23, 2011.

FIELD OF THE INVENTION

The present invention relates to a brush ring or a disk brush having a ring-like frame part, which can be slid axially onto a shaft and can be non-rotatably fastened to the shaft for forming a sweeping roller.

BACKGROUND OF THE INVENTION

Brush rings or disk brushes are known, for example, from DE 39 14 745 A1 and corresponding U.S. Pat. No. 4,998,316 issued Mar. 12, 1991. They have a substantially circular frame on which radially outwardly protruding bristles are arranged. To form a sweeping roller, several such disk brushes are slid onto a rotatably mounted shaft, and are non-rotatably connected to the rotatable shaft.

To produce such disk brushes, it is provided, for example, to supply wires or similar bristle material, cut to length, successively to an extruder by way of an end portion in order to provide the ends with a thermoplastic material. The bristle bands prefabricated in this manner can then be bent into a ring-shaped form and then, in particular before a final cooling of the thermoplastic compound, can be pressed into their final, for example, circular form.

The most varied geometries of disk brushes and brush rings exist. The brush ring, which lies radially on the inside and accommodates the bristles, can, for example, have an extensively planar, but also a zigzag-shaped structure. Such zigzag-shaped or wavy structures contribute to a uniform bristle density on the outer circumference of the sweeping roller. Scoring on the substrate to be cleaned can also be counteracted by a zigzag or wave profile.

EP 1 009 254 B1 and corresponding U.S. Pat. No. 6,205,609 B1 issued Mar. 27, 2001, make known a further brush ring which is produced completely from recyclable production material and where the circumference of the frame part has been arranged in order to project at least two points with substantially flat side surfaces laterally of a bottom base. With the brush rings abutting directly against one another in the axial direction, the substantially flat side surfaces are in direct contact with one another such that, when a sweeping roller is operating, the individual brush rings do not start to vibrate.

In the transition between the substantially flat side surfaces, the previously known frame part has in each case really clearly pronounced kinks which, in the case of extreme mechanical stress, provide a weak point in the operation of the brush disk. There can be cracking or even fractures in the region of these types of kinks in the frame part.

In addition, EP 1 647 201 B1 published Sep. 5, 2007, makes known a brush ring arrangement, the core of which has several portions which are stepped in the axial direction, realized in a substantially even manner and also merge into one another by means of really concisely realized kinks.

Finally, WO 2005/034678 A1 discloses a substantially even brush ring, on the inside of which individual projections are integrally formed which, however, when viewed in the axial direction, extend within the extension of the bundle of bristles arranged on the frame.

Common to all the brush rings known currently is that they are to be connected in a non-rotatable manner to the shaft which accommodates them. Amongst themselves, however, the brush rings, which come to abut against one another, have no direct connection to one another.

Consequently, it is the object of the present invention to provide a brush ring for a sweeping roller which has improved mechanical characteristics, which can be fastened to a shaft in a universal manner and in different configurations and which, where possible, bestows on the sweeping roller a greater degree of stability.

At the same time, the aim of the present invention is to improve and to simplify the assembly and disassembly of brush rings on a rotatable shaft and also the manageability of the brush rings as semi-finished products.

SUMMARY OF THE INVENTION

The object underlying the invention is achieved with a brush ring according to the invention shown and described herein and as claimed in the claims appended hereto, as well as with a sweeping roller, according to the invention show and described herein and as claimed in the claims appended hereto. Additional advantageous embodiments of the invention are the subject of the dependent claims appended hereto.

A brush ring according to the invention has a ring-like frame part, on which radially outwardly protruding bristles can be fastened. For forming a sweeping roller, the brush ring or the brush disk which is provided with bristles, in this case, can be slipped axially onto a shaft. In this case, a driving device is provided on the frame part, the frame part being non-rotatably connectable to the shaft by means of the driving device. In a preferred manner, the frame part has a driving device which projects radially inward, for instance in the form of one or several pins which are directed radially inward and can be inserted into a corresponding recess or groove of the shaft.

In an exemplary embodiment, the frame part is produced from a thermoplastic material and can consequently be connected to the bristles in a positive locking and/or positively bonded manner. The bristles, which are to be fastened on the frame part, can equally be produced from a thermoplastic plastics material, for instance from polypropylene, but also from metal, in particular corrugated metal wire.

When viewed in the circumferential direction, the frame part has ring portions which are arranged offset with respect to one another in the axial direction. More particularly, the frame part has a zigzag-like, and preferably, a wave-like profile, such that the radially outside ends of the bristles do not lie in one plane, but, when viewed in the circumferential direction, come to lie offset axially with respect to one another. Those ring portions which lie offset axially with respect to one another can be viewed as elevated and recessed ring portions, for instance when the brush ring is placed on a substrate.

The frame part has, in addition, connecting means which are realized in the axial direction and, with reference to a center point axis, which runs through the driving device and the ring center point, are arranged symmetrically with respect to one another. The symmetrical configuration, in this case, is not only restricted to the connecting means but can also refer to the configuration of the corresponding frame parts. The symmetrical configuration and/or arrangement of the connecting means, in this connection, is such that, with reference to a center point plane which is formed by the center point axis and a ring axis, they are arranged in a symmetrical manner, and more particularly, in a mirror-symmetrical manner. On the frame part, the connecting means are integrally formed or realized on the frame part. The ring axis extends in the axial direction and runs through the ring center point of the frame part, whilst the center point axis can run perpendicular hereto, for instance aligned parallel to the plane of the frame part also through the ring center point. The center point plane formed by the ring axis and the center point axis separates the ring or its frame part at least in a virtual manner into two mirror-symmetrical frame halves.

The connecting means enable a direct connection between individual brush rings themselves. In an exemplary embodiment, the connecting means are arranged, with reference to a horizontally placed brush ring, on the axial top and/or bottom side thereof such that brush rings which abut against one another, in particular which lie one on top of another, can already be non-rotatably connected together themselves. The connecting means, in this case, have axial positive locking means, which are realized in particular so as to correspond to one another and which, with reference to a cross sectional profile, which is substantially constant or invariable in the circumferential direction of the frame part, are realized as an elevation and/or as a recess.

By the positive locking means being realized as an elevation which protrudes from the frame part in the axial direction, the frame part, precisely in the region of the positive locking means, can have bestowed upon it a cross section which is enlarged by the thickness or the structure of the positive locking means and consequently increased mechanical stability, such that precisely those ring portions, which are provided to transfer a torque to adjacently arranged brush rings, are able to have a demanded stability which makes it possible for a brush roller which is equipped in such a manner to operate in the long term in a reliable and secure manner.

Along with improved mechanical characteristics, the direct connection between several brush rings themselves makes it possible for the brush rings to be assembled on the shaft in a simplified and more efficient manner. The handling of the brush rings, in particular for transport purposes, can be improved and simplified in this way too. A direct connection or coupling of frame parts which transfers torque between brush rings which are arranged adjacently in the axial direction, is effected, in this connection, preferably in a bi-directionally manner in the circumferential direction. The frame parts, which are interlocked by means of the positive locking means, are operatively connected extensively without slip or in a slip-free manner even in the case of a change in the direction of a rotational movement.

By the connecting means being arranged in a symmetrical manner, in particular in a mirror-symmetrical manner with respect to the center point axis, the individual brush rings can be fastened on the shaft, for example alternately, in each case in the reverse alignment with respect to one another, wherein the driving device, for forming a non-rotatable connection between the brush ring and the sweeping roller, is also realized in a symmetrical manner with respect to the center point axis, or more precisely in a mirror-symmetrical manner with respect to the center point plane which runs through the center point axis. That is to say that the brush ring is to be non-rotatably mounted on the shaft both in an original alignment and in an alignment rotated about the center point axis by one hundred eighty degrees (180°). By the connecting means also being arranged in a symmetrical manner with respect to the center point axis, they can also correspond to one another both in an original configuration, or in a configuration of adjacent brush rings aligned identically to one another, and in a rotated configuration and in a direct manner can provide an anti-twist means for brush rings which abut against one another in an adjacent manner.

Through a preferred anti-twist connection between the brush rings, irrespective of a common arrangement on a shaft, the process of assembling the brush rings on the shaft can be simplified in such a manner that, for example, a predetermined number of brush rings can be assembled and bundled in a quasi preconfigured manner already among themselves to form a brush ring package and then can be slid onto the shaft in one operation as a package. In this manner, individual brush rings can also be precisely positioned and aligned already with respect to one another before being slid onto a common shaft.

By rotating the brush ring substantially one hundred eighty degrees (180°) about its center point axis, which extends through the driving device and, in a preferred manner, perpendicular with respect to the ring axis which runs in the axial direction, the connecting means can be imaged quasi on themselves in order to make possible a reciprocal arrangement of adjacent brush rings in an identical alignment and/or in an alignment rotated by one hundred eighty degrees (180°).

Deviating hereto or as an alternative to this, it can be additionally provided that the connecting means are realized so as to correspond to one another, with reference to the center point axis of the brush ring. For example, a connecting means which is situated away from the center point axis by thirty degrees (30°) can have such a form that it corresponds to a connecting means arranged at negative thirty degrees (−30°) on the brush ring, namely whenever a second identically realized brush ring rotated about the center point axis by one hundred eighty degrees (180°) comes to abut against that first brush ring.

Pin-like or mandrel-like projections as well as recesses and accommodating means which are realized so as to correspond hereto are used as axial positive locking means which are realized so as to correspond with one another. In addition, it is possible to provide jagged-like projections, which extend, for example, in the radial direction and are triangular in the axial cross section, and corresponding recesses as well as corresponding tooth faces.

The positive locking means can also form a type of latching and/or can produce a clamping effect in order to simplify the forming of brush ring packages and the handling thereof. Thus, through positive and/or frictional locking means on the axial top and bottom sides of the brush rings, a reciprocal fixing of this type can be created which prevents in an extensive manner individual brush rings automatically becoming detached before final assembly on the shaft.

In an advantageous exemplary embodiment, the connecting means which extend in the axial direction have one or several tooth faces which can be moved into engagement with corresponding tooth faces of a further brush ring which is to be arranged adjacent to the brush ring. Preferably, in this connection, the tooth faces extend over the entire radial width of the ring such that a torque acting on a first ring can also be transferred directly between adjacently arranged brush rings. In this connection, the tooth faces have projections which are realized in the axial direction and recesses which correspond hereto. Preferably, in this case, the projections and recesses are realized so as to be jagged-like or in triangular geometry.

The toothed geometry, in particular the teeth which are arranged adjacent to one another in the circumferential direction, can be realized as protruding from the cross sectional profile of the frame part such that, at their deepest point with reference to the axial direction, the valleys or recesses which lie between the teeth lie, for instance, in the region of the outer circumference of a flat ring portion which comes to rest abutting against the corresponding tooth face.

Thus, in an exemplary embodiment, it is provided that the connecting means have at least one pin, which protrudes axially from the frame part, and, in a mirror-symmetrical manner hereto with respect to the center point axis, a recess which is realized so as to correspond to the pin. In this way, in the case of two identically realized frame parts or brush rings, a clamping effect can already be generated by one of the frame parts, rotated by one hundred eighty degrees (180°), moving to abut against the other frame part in such a manner that the pin and the recess interlock in a clamping manner.

In an advantageous exemplary embodiment, it is also provided that, for forming a clamping cone, the pin is realized tapered toward its end, and that the corresponding recess has at least one side cheek which corresponds hereto. In this connection, depending on the configuration of the cone and of the corresponding side cheek, a clamping action between the pin and the recess can also be formed, preferably with adjacent frame parts moving to abut directly against one another by way of their axial side faces. Reciprocal axial supporting is consequently effected preferably by means of the side faces of the brush rings, whilst a torque-transferring positive lock between adjacent brush rings is affected predominantly by means of interlocking pins and recesses corresponding hereto.

A possible transfer of mechanical vibrations from one brush ring to adjacent brush rings can consequently be counteracted. Through the reciprocal clamping of the brush rings and/or through the axial supporting, a type of vibration decoupling or vibration damping can also be provided when the sweeping roller, which is created in this manner, is operating.

In an advantageous exemplary embodiment, it can additionally be provided that the positive locking means extend by way of axial projections and recesses which correspond hereto substantially over the entire radial width of the frame part. In this connection, it generally applies that the axial height or depth of the projections, or more precisely of the recesses, can be reduced down to a minimum dimension as the radial width increases. It is advantageous, namely, to keep the axial extension of the positive locking means as small as possible in order to impair the mechanical stability of the frame part by the connecting or positive locking means as little as possible.

In an advantageous exemplary embodiment, it is also provided that the connecting means are arranged in such a manner on an axial top side and on an axial bottom side, that is on both sides of the frame part, that the connecting means, in the case of an arrangement of several structurally identical brush rings rotated alternately about the center point axis, are in each case able to be moved so as to interlock. In this connection, it is also conceivable that, in the case of a correspondingly symmetrical configuration of connecting means, the connecting means can also be moved so as to interlock even where an arrangement of adjacent brush rings has not been rotated, such that the end user can always secure the frame parts themselves in the direction of rotation and this independently of whether they are rotated about the center point axis or are aligned identically with respect to one another.

In an advantageous exemplary embodiment, it is provided that the connecting means are always arranged on the top side of an elevated ring portion and/or on a bottom side of a recessed ring portion. In this case, the connecting means extend above the peak point of an elevated, or more precisely of a recessed ring portion, when viewed in the circumferential direction of the ring. In the majority of cases, no connecting means are provided between the elevated and the recessed ring portions.

Depending on the predetermined requirement profile, the connecting means can be realized on any elevated and/or any recessed ring portion, but also just singly on some selected elevated or recessed ring portions. It is additionally conceivable for connecting means, which are realized in each case in a symmetrical manner or so as to correspond to one another, to be provided on both sides on elevated and recessed ring portions.

In addition, in an advantageous exemplary embodiment, it is provided that a connecting means has on an elevated and/or recessed ring portion, positive locking means, which, when viewed in the circumferential direction of the frame part, for example side by side and/or one behind another and correspond with one another in each case.

In particular when the driving device, which is operatively connected to the shaft, is arranged at the peak point of an elevated or recessed ring portion, that ring portion can also be provided with a connecting means which is realized in a symmetrical manner or so as to correspond to the center point axis.

In addition, it is proven as advantageous for the invention when elevated and recessed ring portions are realized in a substantially convexly and/or concavely curved manner and merge directly into one another. In this respect, as harmonic, kink-free and wave-like a configuration as possible is provided for the brush ring or for the frame part thereof, which configuration, when viewed in the circumferential direction, has either a continuously increasing or continuously reducing gradient.

A frame part formed harmonically in such a manner can withstand the mechanical loads occurring during operation in a sufficient manner, whilst, according to experience, at kinks of previously known brush rings, material fatigue and material weaknesses, for instance in the form of fractures, can come to light.

In an advantageous exemplary embodiment, it is additionally provided that the frame part, when viewed in the circumferential direction, has a continuously arched, alternately curved, somewhat wave-like outer contour, it being possible for the connecting or positive locking means to be provided in each case alternately on the convexly curved outer radius of the top and bottom side of the frame part.

In addition, it is proven to be advantageous when a connecting means is realized in each case both on the top side and on the bottom side of an elevated and/or a recessed ring portion. If for instance three elevated and three recessed ring portions are provided, in a parallel aligned arrangement of adjacent brush rings a total of six corresponding connecting points can be formed, namely in each case on the elevated and on the recessed ring portions. In a configuration rotated by one hundred eighty degrees (180°), the top sides and the bottom sides of two adjacently strung together frame parts then move into reciprocal abutment at in each case three points.

In yet another advantageous exemplary embodiment, the connecting means has first positive locking means, which are recessed and elevated in a wave-like manner in the axial direction and are provided in each case with second positive locking means, which are realized in the axial direction as a pin and recess. In this connection, two positive locking profiles of the frame part which correspond to one another are geometrically superposed. Whereas, for example, the first wave-like positive locking means, which can be moved so as to interlock, already form an anti-twist means, the second positive locking means, which are realized as a pin and recess, however, contribute predominantly to a clamping effect and consequently to a latching of brush rings which are arranged directly abutting against one another.

It is provided in particular that a brush ring according to the invention is in a first configuration of brush rings with several identically realized brush rings which are stacked into each other in the axial direction, and also in a second configuration, in which brush rings, which are to be adjacently arranged, are arranged rotated in an alternate manner about the center point axis, are able to be connected together by means of the connecting means, preferably by way of only one type of connecting means.

It is advantageous for all the connecting means, which come to rest on top of one another or side by side through rotation about the center point axis, to be realized in an identical manner or axially adjacent brush rings can be moved so as to interlock in a corresponding manner to form a torque-transferring connection.

In another exemplary embodiment, the invention also relates to a sweeping roller having a shaft, which is realized in a substantially cylindrical manner and is rotatably mounted for instance in a sweeping roller, on which shaft a number of the previously described brush rings are mounted by means of driving devices, which are arranged in an aligned manner with respect to one another in the axial direction so as to be non-rotatable on the shaft, and by means of the described connecting means are also non-rotatably mounted directly amongst themselves.

Further objects, features and advantages of the present invention are clarified in the following description of exemplary embodiments with reference to the accompanying drawing figures. In this connection, all the features described in the text and illustrated in the drawing figures, both standing alone and in any sensible combination together, are intended to be encompassed by the appended claims.

DETAILED DESCRIPTION OF EXEMPLARY EMBODIMENTS

Figure 2:
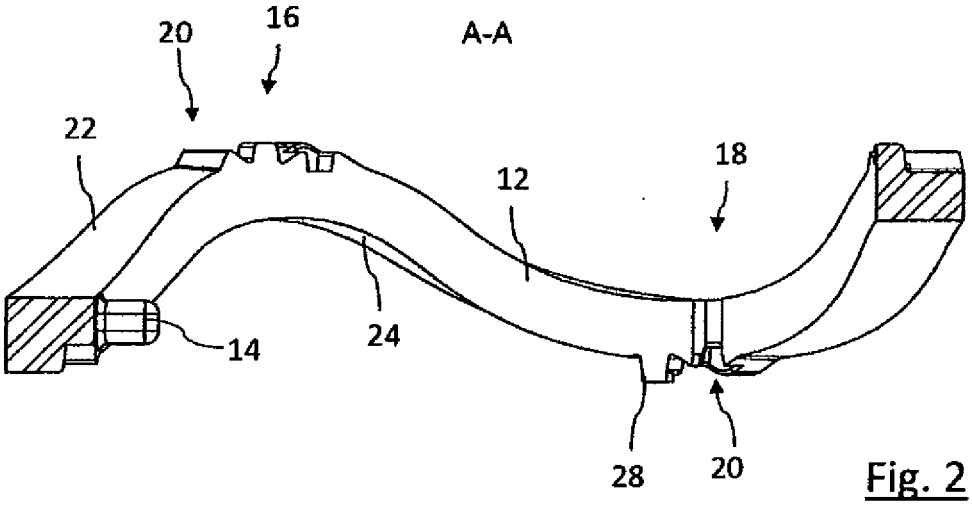
FIG. 2 is a cross section through the frame part of FIG. 1 taken along the line A-A.
Figure 3:
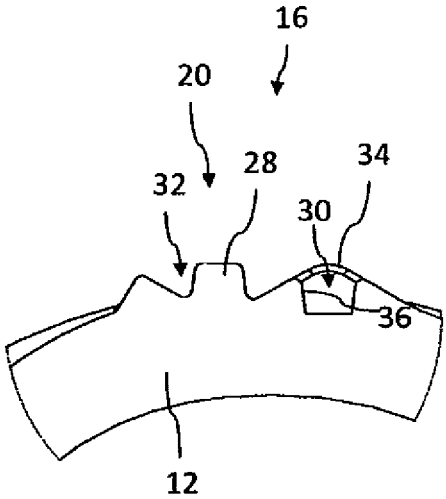
FIG. 3 is an enlarged detail from the view of FIG. 4.
Figure 4:
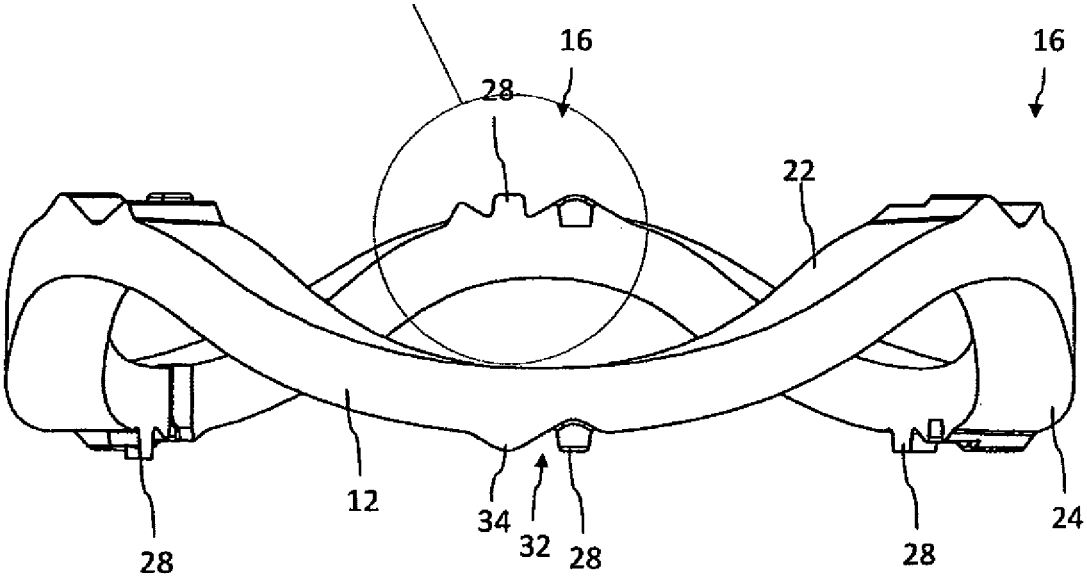
FIG. 4 is a perspective view of the frame part of FIG. 1 lying on a substrate.

FIG. 1 to FIG. 6 show an exemplary embodiment of a disk brush 10 without trimming material, that is without associated bristles. The disk brush 10 has a ring-shaped frame part 12 which, as shown in FIG. 4, has a wave-shaped contour. In total, the frame part 12 has three elevated ring portions 16 and three recessed ring portions 18 lying in between. Connecting means 20, which are realized for forming a positive locking connection, are provided on each of the axially outside sides of elevated and recessed ring portions 16, 18.

Figure 1:
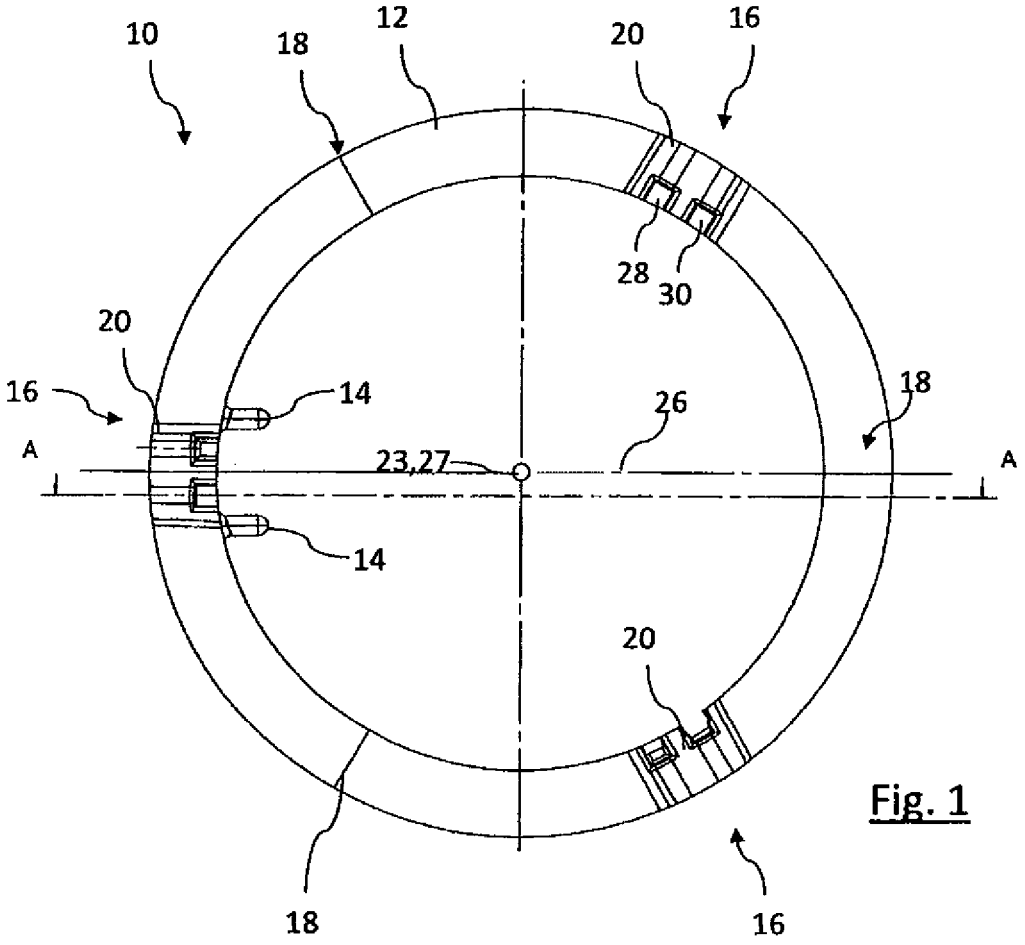
FIG. 1 is a top view from above the frame part of an exemplary embodiment of a brush ring according to the invention.
Figure 5:
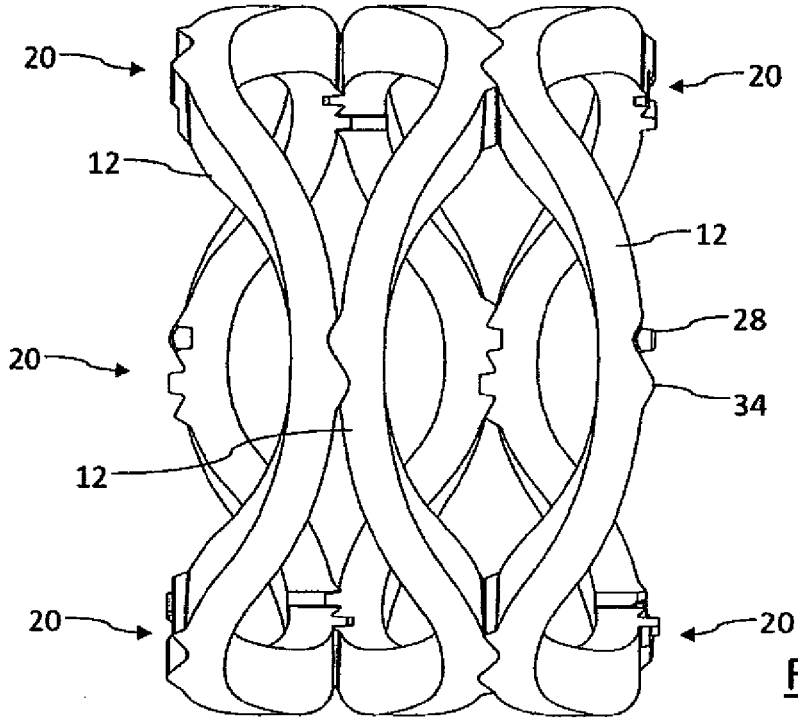
FIG. 5 shows three frame parts according to FIG. 1 to FIG. 4 situated in the final assembly position.

The connecting or positive locking means 20 can be moved into engagement with one another by rotating the brush ring or the frame part 12 about the center point axis 26, as is shown in FIG. 5. The center point axis 26, in this connection, runs substantially parallel to the ring plane and through a driving device, which is formed in the present case by two radially inwardly directed pins 14, by means of which each individual brush ring 10 can be non-rotatably mounted on a shaft (not shown explicitly in the drawing figures), and through the geometric ring center point 23. FIG. 1 indicates a ring axis 27 which also runs through the ring center point 23, and in the representation according to FIG. 2, perpendicular with respect to the plane of the representation, that is toward the observer. The ring axis 27, together with the center point axis 26, spans a center point plane 25, with reference to which the connecting means and/or positive locking means 20 are arranged or aligned in a mirror-symmetrical manner with respect to one another.

The non-rotatable bearing arrangement of the brush rings on the shaft, in this connection, is such that one single ring is able to be fastened equally on the shaft (not shown explicitly in the drawing figures) both in a first configuration and in a second configuration, rotated substantially about one hundred eighty degrees (180°) about the center point axis 26. By the connecting means 20 also being arranged symmetrically with respect to the center point axis 26, or more precisely the center point plane 25, and/or accordingly being realized symmetrically or correspondingly hereto, in the case of an alternating arrangement of the brush rings, or an arrangement of the brush rings alternately rotated by one hundred eighty degrees (180°) in the axial direction, a non-rotatable interlocking of the connecting means with reference to both conceivable directions of rotation can be achieved.

As shown in FIG. 2 to FIG. 4 and in an enlarged manner in FIG. 3, the connecting means 20 has a wave profile 32, 34 which extends extensively completely over the frame part 12 in the radial direction and which, as shown in FIG. 5, is suitable for forming a non-rotatable or a torque-transferring connection between adjacent brush rings.

In addition, the wave-like positive locking profile 32, 34 is also provided with an axially protruding pin 28 and a recess 30 which is realized corresponding hereto. Both the pin 28 and the recess 30, in this case, are realized radially inside on the frame part 12. The pin 28, in this case, is superposed on the wave-like recess 32 and the accommodating recess 30 is superposed on the wave-like projection 34. Both the pin 28 and the recess 30 corresponding thereto, or the side cheek 36 thereof, have an at least slightly conical configuration in the axial direction such that the frame parts 12, which are, for example, adjacent to one another in FIG. 5 and in a preferred manner come to abut directly against one another, can be clamped together by means of the second positive locking means 28, 30 and consequently can be connected together in a positive locking manner.

In this way, irrespective of a final assembly on a shaft, a package or a bundle of brush rings can already also be placed one on top of another in a type of final assembly configuration such that a package of brush rings formed in this manner can be slid onto a shaft provided for this purpose in one single subsequent operation and can be positionally fixed on the shaft.

As can be seen by way of FIG. 1 to FIG. 6, the frame part 12 both on its top side 22 and on its bottom side 24 has in each case three connecting means 20 which are spaced apart from one another by one hundred twenty degrees (120°) in the circumferential direction and are each realized in an identical manner. Deviating from the configuration shown, for example, in FIG. 1, the left-hand connecting means 20, situated in the region of the driving device 14, could also have a configuration deviating from the remaining connecting means 20. It would simply have to be able to form a torque-transferring connection by rotating or folding about the axis 26 or plane 25 with itself.

Figure 6:
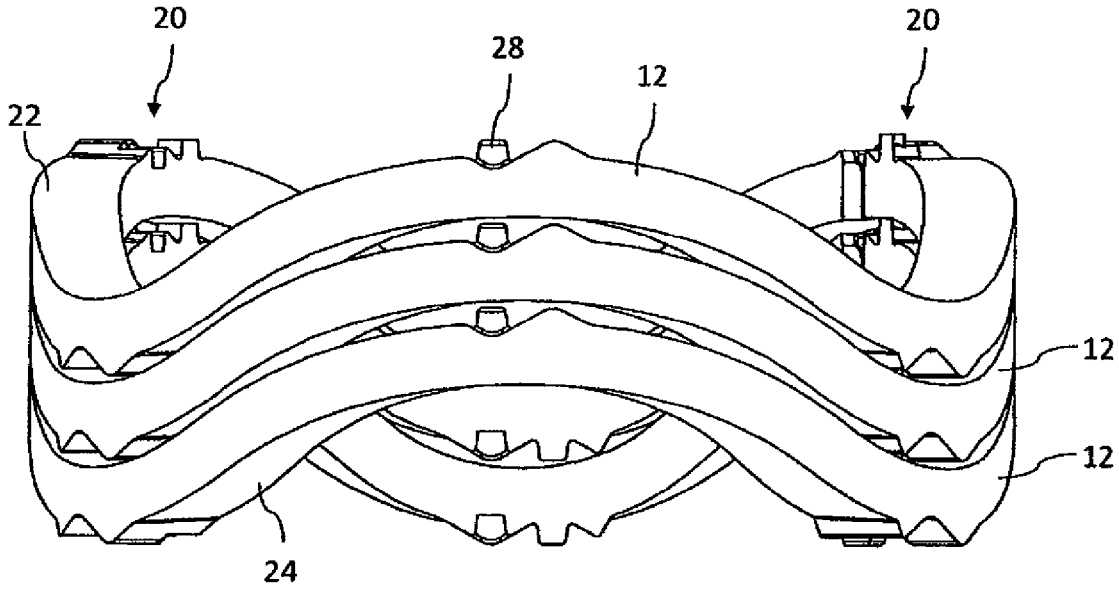
FIG. 6 shows three brush rings according to FIG. 5 in a transport configuration stacked into one another.

In the transport configuration stacked into one another shown in FIG. 6, the individual frame parts 12 are, however, not connected together.

Figure 7:
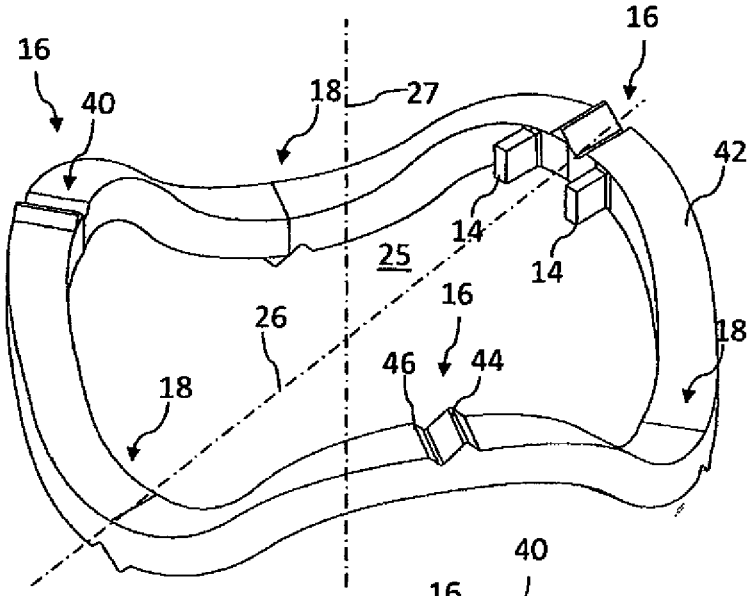
FIG. 7 is a perspective view of another exemplary embodiment of a frame part according to the invention.
Figure 8:
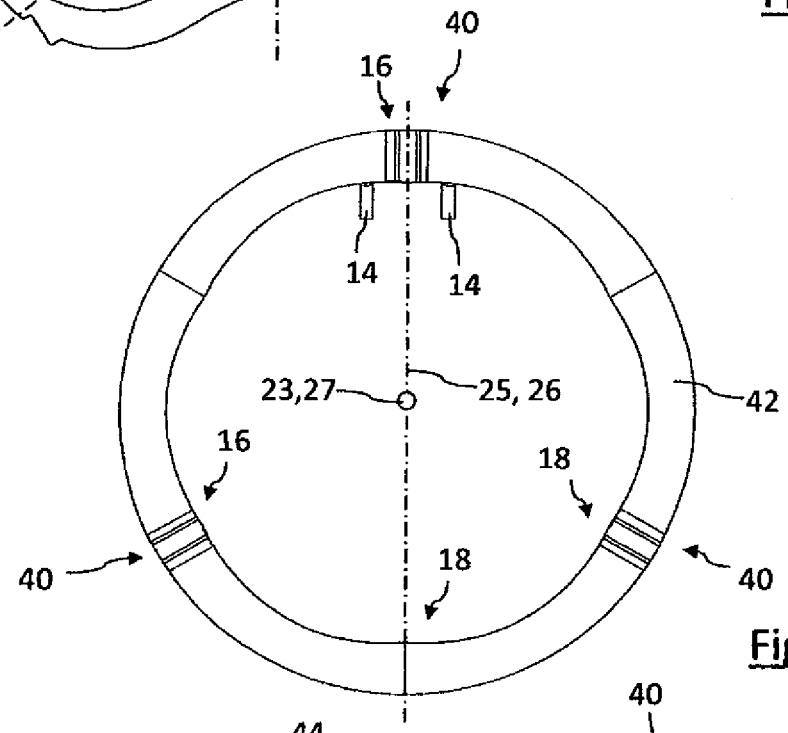
FIG. 8 shows the frame part of FIG. 7 viewed from above.
Figure 9:
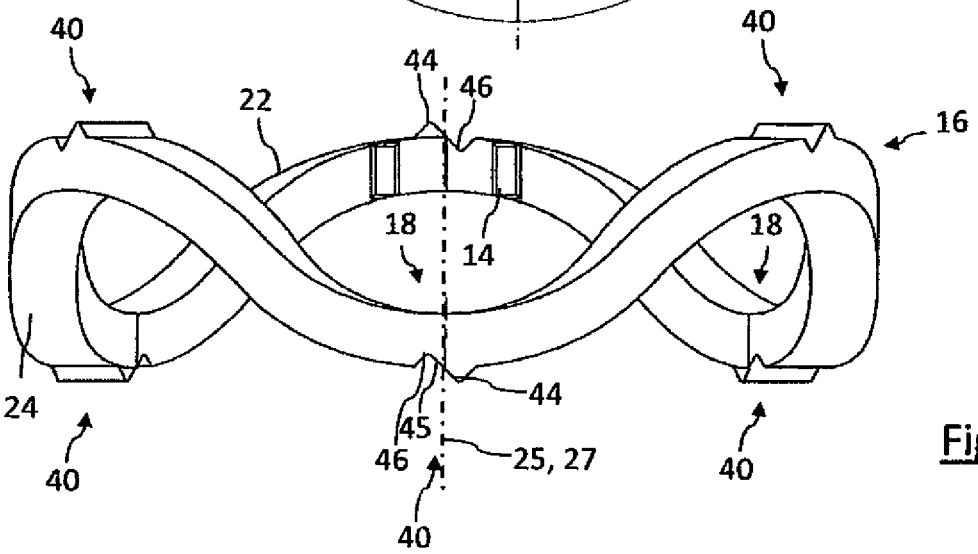
FIG. 9 shows the frame part of FIG. 7 and FIG. 8 viewed from the side.

FIG. 7 to FIG. 9 show another exemplary embodiment of a frame part 42 which also has a connecting means 40 both on the top side of three elevated ring portions and on the bottom side of recessed ring portions lying in between. The connecting means 40 is formed by a recess 46 which extends over the entire radial width of the ring 40 and by an elevation 44 which borders thereon in the circumferential direction. An oblique face 45 which is inclined for instance by thirty degrees (30°) to sixty degrees (60°), and preferably by forty-five degrees (45°), and simplifies a stacking one on top of another and reciprocal aligning of the brush rings which abut against one another, extends between the peak points of the elevation 44 and recess 46.

The axial dimension of the positive locking means 44, 46, in this connection, is clearly smaller than the axial thickness of the frame part 42. The recess 46 or the projection 44 amounts to a maximum of 30%, and preferably to less than 20%, of the axial size or thickness of the brush ring 42.

Figure 10:
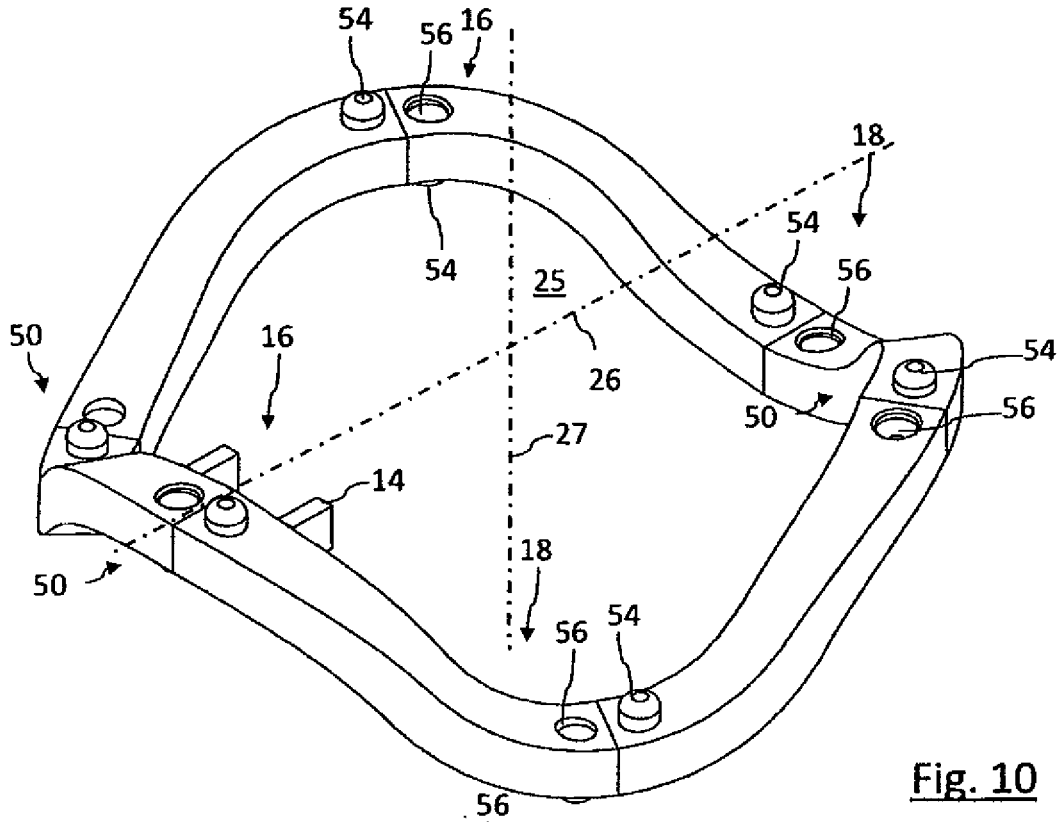
FIG. 10 is a perspective view of another exemplary embodiment of a frame part according to the invention with knob-like clamping elements.
Figure 11:
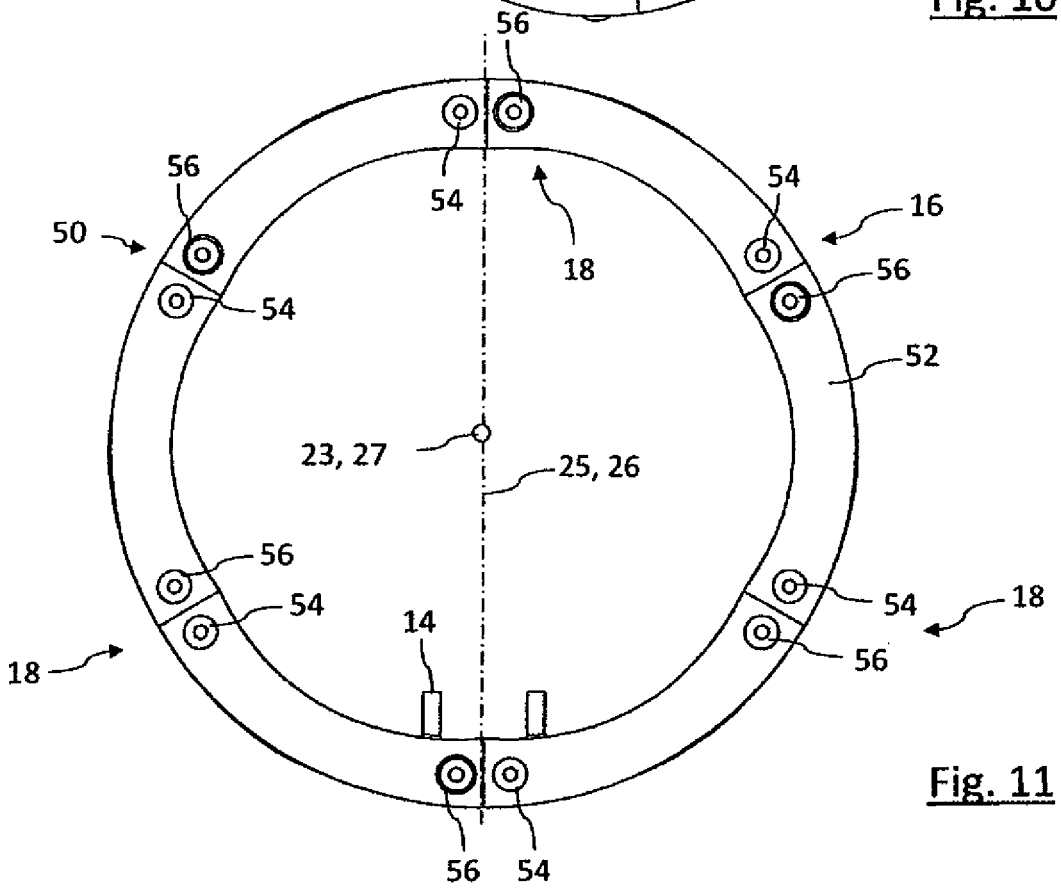
FIG. 11 shows the frame part according to FIG. 10 viewed from above.
Figure 12:
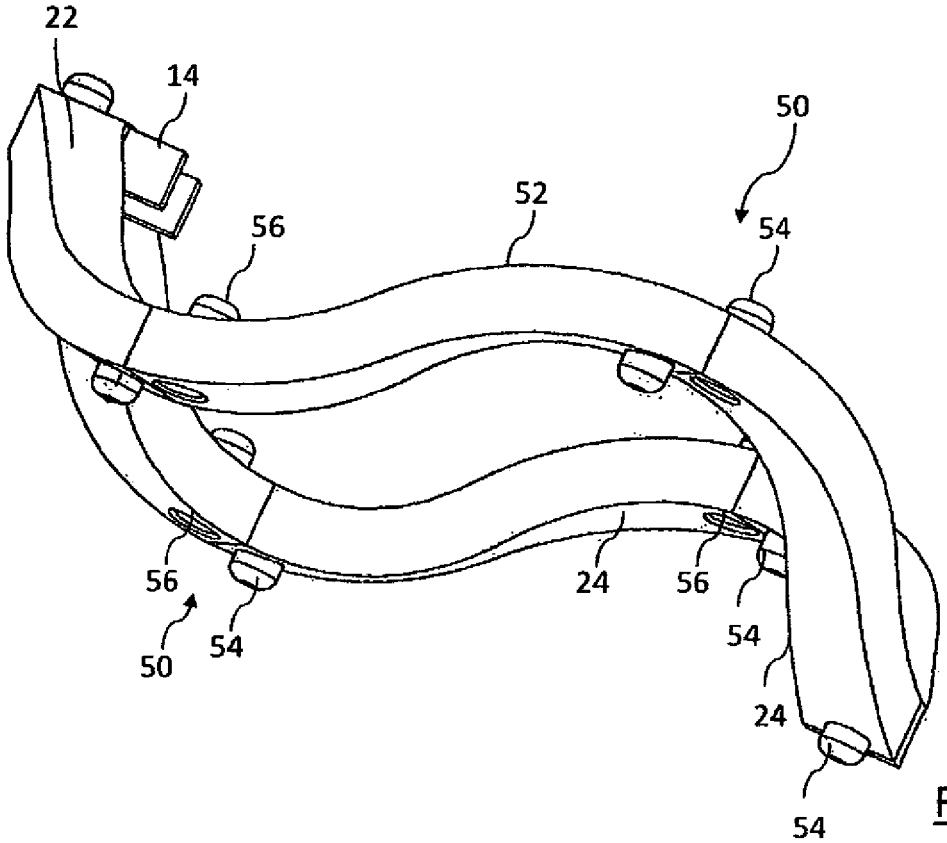
FIG. 12 is an oblique perspective view from below the frame part of FIG. 10 and FIG. 11.

FIG. 10 to FIG. 12 show another exemplary embodiment of a frame part 52 with knob-like connecting means 50. The connecting means 50, in this connection, have a knob-like projection 54 and a recess 56 which is arranged adjacent thereto in the circumferential direction for accommodating the knobs 54. In this case too, a torque-transferring positive locking connection between adjacent frame parts 52 can be provided by rotating them about a center point axis 26, as can be seen from FIG. 13 and FIG. 14. The knob-like projections 54 which are rounded toward the free end thereof can equally come to rest in a clamping manner in the recesses 56 provided for this purpose. Consequently, preconfigured packages or bundles of brush rings 52 can be positionally fixed with respect to one another even before a final assembly on a shaft.

In contrast to the exemplary embodiments shown in FIG. 1 to FIG. 9, in the case of the brush ring 52 shown in FIG. 10 to FIG. 14, six connecting means 50 each with a projection 54 and each with a recess 56 are provided in each case both on the top side 22 and on the bottom side 24. The projections 54 which are realized on the top side 22 of the frame part 52 form, so to speak, the negative image of the recesses 56 which are realized on the bottom side 24 of the brush ring 52. In this connection, the same applies to the recesses 56 on the top side 22 and the projections 54 on the bottom side 24.

The connecting means 50, in this connection, are arranged in an extensively point-symmetrical manner with respect to the peak points of elevated and recessed ring portions 16, 18. In this way, the brush rings can be moved to abut against each other in a torque-transferring manner in an arbitrary rotated configuration, namely both in an identically aligned configuration and in a configuration which is aligned, for instance, rotated in an alternating manner.

Figure 13:
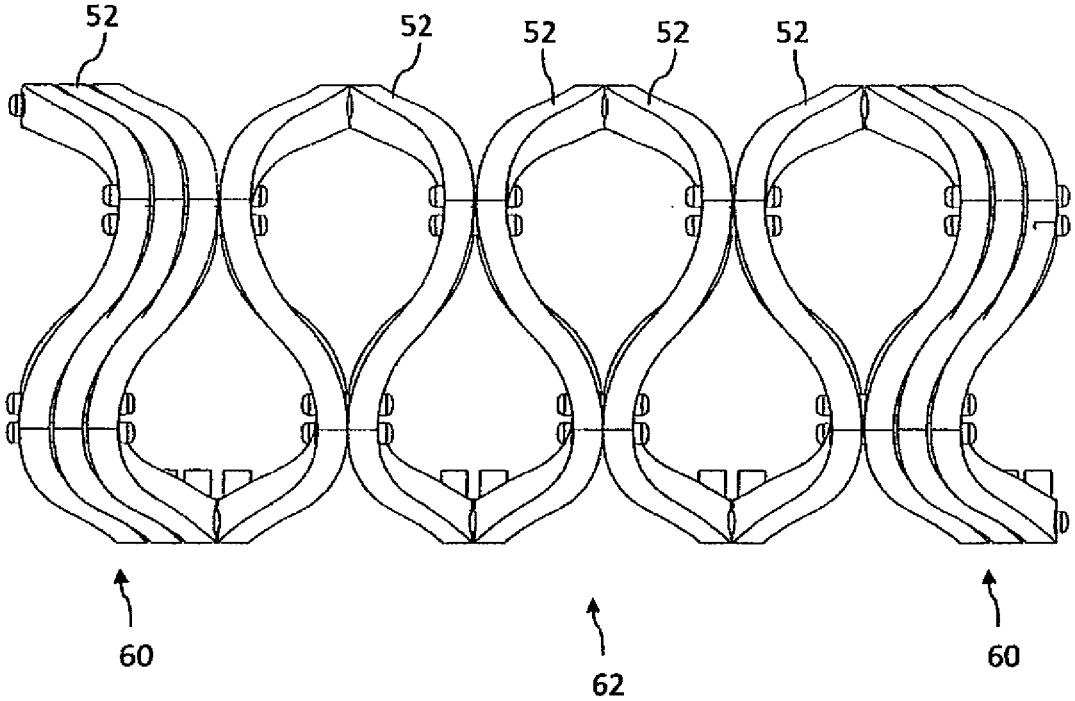
FIG. 13 is a side view of several frame parts according to FIG. 10 to FIG. 12 abutting against one another in different configurations.
Figure 14:
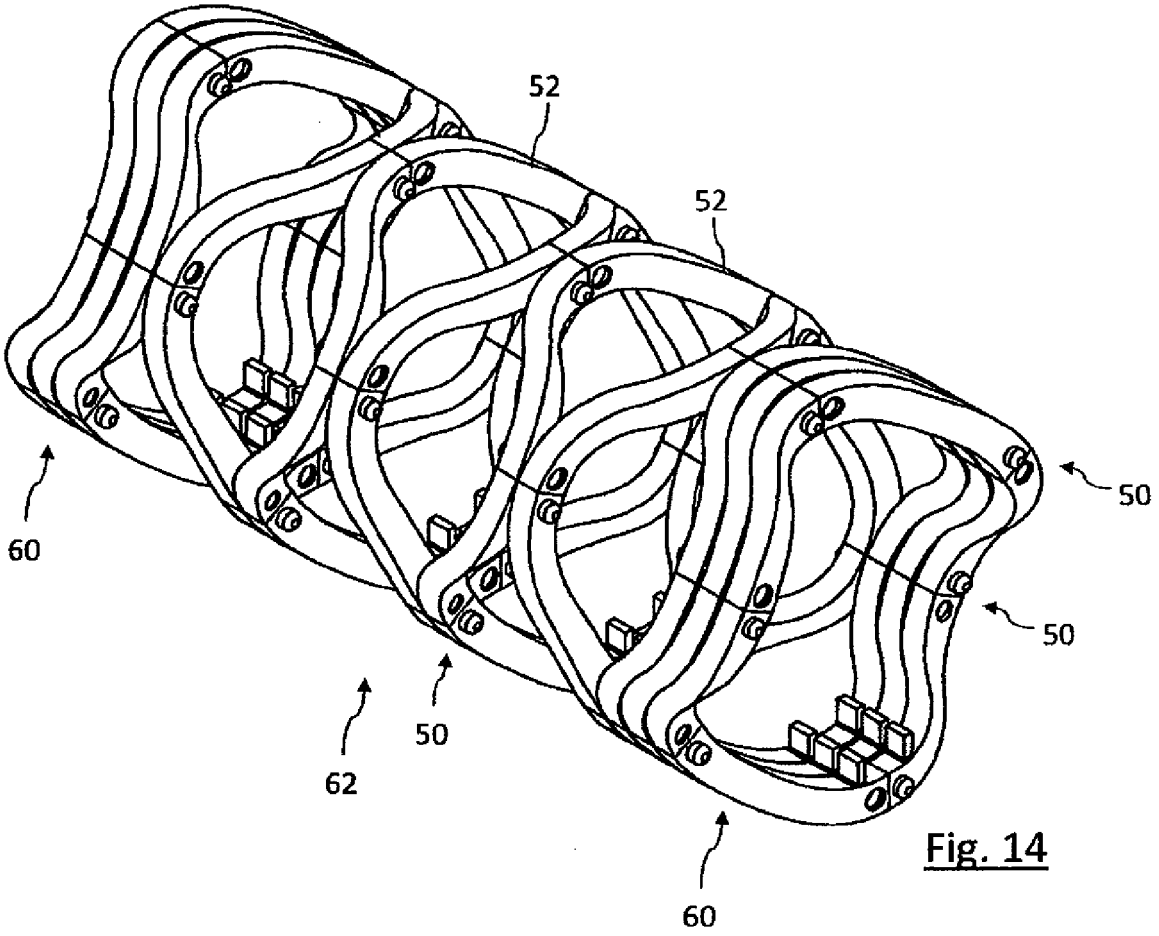
FIG. 14 is a perspective view of the configuration shown in FIG. 13.

FIG. 13 and FIG. 14 show such a scenario. In each case three brush rings 52, which are nested into one another in an identical alignment by means of six connecting means 50, are connected together in the axially outside edge regions, whilst lying in between a brush ring arrangement 62 is formed where brush rings, which are adjacent in the axial direction, are arranged in each case rotated by one hundred eighty degrees (180°) about their center point axis 26, and accordingly, are connected together in a torque-transferring manner by latching or clamping together the positive locking means 54, 56 at, in each case, three connecting points.

Figure 15:
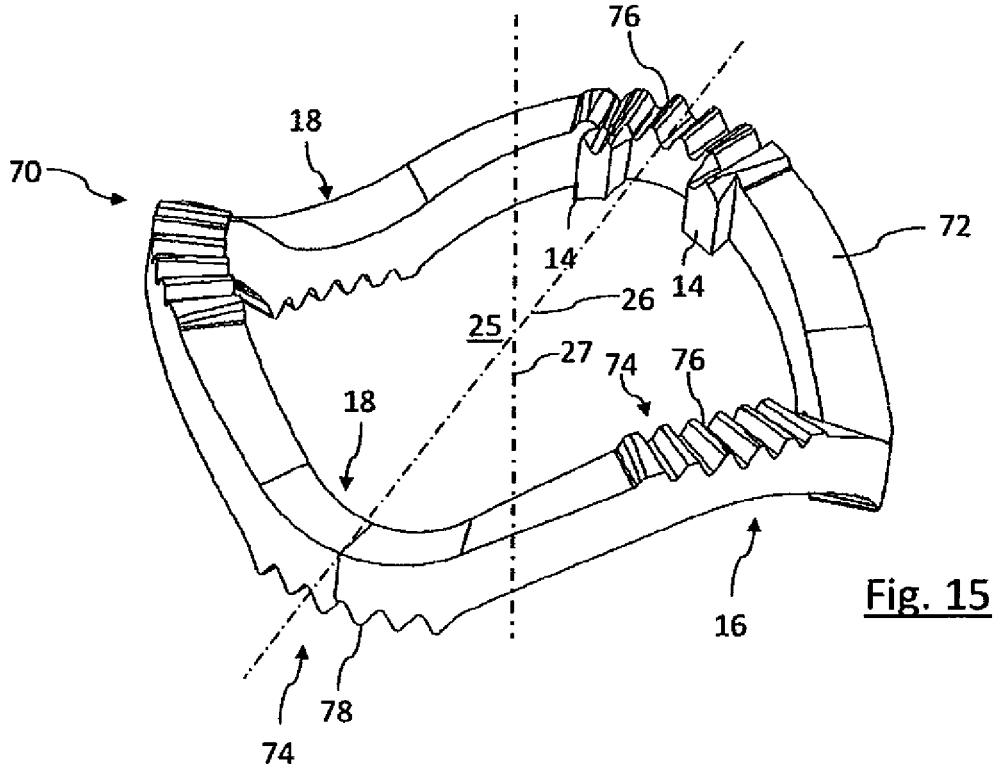
FIG. 15 is a perspective view of a frame part with toothed positive locking means.
Figure 16:
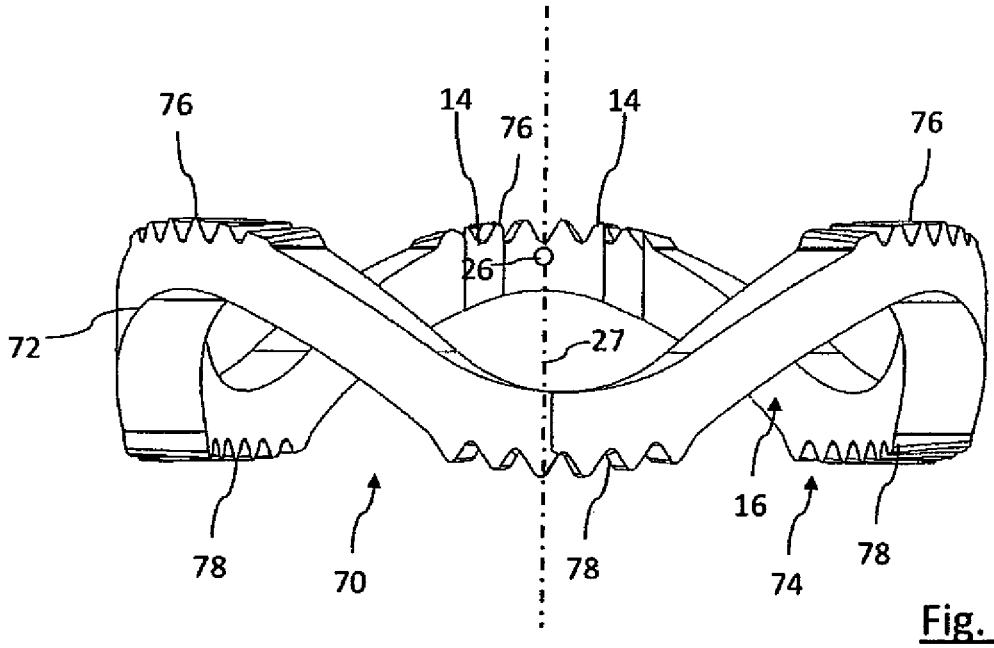
FIG. 16 is a side view of the brush ring according to FIG. 15.

FIG. 15 and FIG. 16 show another exemplary embodiment of the brush rings 70 according to the invention. The frame part 72 thereof, in this connection, has a wave-like or alternately concavely and convexly arched structure with tooth faces 76, 78 which are realized at the recesses and elevations as positive locking means or connecting means 74. The teeth of the tooth faces 76, 78, in this case, are aligned in the radial direction, as can be seen particularly clearly in the side view according to FIG. 16. The tooth faces 76, 78 extend additionally over the entire radial width of the ring 72. The brush ring 70 or the frame part 72 thereof, in this case, is realized in a toothed manner purely in sections, in particular at the peak point of the wave-like contour. In particular, only the ring portions, which are realized concavely arched alternately on the top and bottom side of the frame part 72 in the circumferential direction, are provided with a toothing 76, 78.

In this connection, it is provided in particular that the tooth-like or triangle-like projections of the tooth faces 76, 78 stand out from the adjoining flat or even outer ring structure so that the frame part 72 still has a sufficient material thickness and strength even in the region of the tooth-like recesses of the tooth faces 76, 78.

The toothing 76, 78 is additionally realized as a superposition with respect to the wave-like basic geometry of the frame part 72. Thus, the frame part 72, in the region of the toothings 76, 78, has a cross sectional area which is enlarged by the axial structural height of the individual teeth 80. The frame part 72, consequently, in particular in the region of the force-transferring and torque-transferring positive locking means 76, 78, experiences mechanical strengthening and stiffening produced by this comparatively thicker configuration. The realization and the integral incorporation of the positive locking means in the frame part consequently do not result in a weakening of the ring structure but rather even strengthening it.

Figure 17:
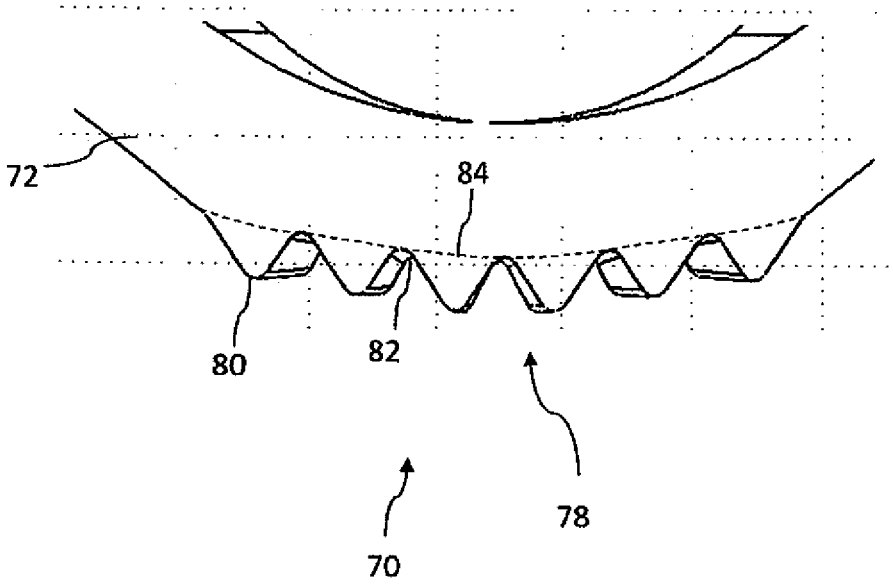
FIG. 17 is an enlarged detail view of the brush ring of FIG. 16.

The strengthening of the ring structure is shown in the enlarged representation in FIG. 17. The roots or intermediate valleys 82 of the teeth 80, which extend in the axial direction away from the imaginary outer geometry 84 of adjacent frame portions, are situated in the region of the outer contour 84 of the frame part 72, shown by the dotted line. The valley portions or tooth spaces 82 consequently do not provide any weakness in the frame part.

In addition, a continuously slightly curved outer contour of the frame part 72 is shown clearly in FIG. 17. Thus, the toothed faces 76, 78 forming the positive locking means have themselves a configuration which corresponds to the rounding or arching of the frame part 72.

Depending on the area of application and the appearances of wear on the brush rings and sweeper rollers expected therefrom, a large or smaller axial bristle thickness can be provided by the variable and universal alignment of the brush rings amongst themselves.

Although the exemplary embodiments shown and described herein disclose only brush rings with in each case three elevated and recessed ring portions, the invention is in no way so limited. Depending on the material used and the axial offset of the ring portions provided, far more, for instance four, five or even up to ten elevated and recessed ring portions can be realized in the frame part. In addition, the invention is in no way limited to a certain trimming material, such as for instance metal wire or polypropylene bristles. It is advantageous when the brush ring or the frame part thereof is realized as a pressure cast part or injection molded part and is produced from a thermoplastic plastics material, and more preferably, a thermoplastic elastomer. As well as this or as an alternative to it, frame parts which are produced from metal, in particular as a sheet metal pre-form, are also conceivable and within the intended scope of the invention.

The invention claimed is:

1. A brush ring for forming a sweeping roller, comprising:

a ring-like frame part on which radially outwardly protruding bristles are fastened, the frame part configured for being slid axially onto a shaft of the sweeping roller and non-rotatably fastened to the shaft by means of at least one driving device;

wherein the frame part, when viewed in a circumferential direction, has ring portions arranged offset with respect to one another in an axial direction and connecting means extending in the axial direction that are arranged symmetrically with respect to one another with reference to a center point plane formed by a center point axis and a ring axis;

wherein the center point axis runs through the driving device and a ring center point;

wherein the ring axis extends through the ring center point and is aligned in the axial direction; and wherein the connecting means have axial positive locking means arranged so as to correspond with one another and to be substantially constant in the circumferential direction, the connecting means comprising tooth faces defining projections and recesses in the axial direction.

2. The brush ring as claimed in claim 1, wherein the connecting means are arranged in a mirror-symmetrical manner with respect to the center point axis.

3. The brush ring as claimed in claim 2, wherein the connecting means have at least one pin that protrudes axially from the frame part and a recess that is configured so as to correspond to the pin.

4. The brush ring as claimed in claim 3, wherein the pin is tapered toward the free end thereof for forming a clamping cone and the recess has at least one side cheek corresponding to the clamping cone.

5. The brush ring as claimed in claim 1, wherein the positive locking means extend over the substantially the entire radial width of the frame part by way of the projections and the recesses corresponding to the positive locking means.

6. The brush ring as claimed in claim 1, wherein the connecting means are arranged on an axial top side and an axial bottom side of the frame part in such a manner that an arrangement of a plurality of identically constructed brush rings rotated in an alternating manner about the center point axis interlock together.

7. The brush ring as claimed in claim 6, wherein the connecting means are arranged on the top side of an elevated ring portion and corresponding connecting means are arranged on the bottom side of a recessed ring portion.

8. The brush ring as claimed in claim 7, wherein the connecting means have positive locking means arranged side by side in the circumferential direction of the frame part that correspond to one another on the elevated ring portion and the recessed ring portion.

9. The brush ring as claimed in claim 8, wherein the elevated ring portion and the recessed ring portion of the corresponding positive locking means are arranged in a substantially convexly and concavely curved manner and directly merge into one another.

10. The brush ring as claimed in claim 7, wherein the connecting means is arranged in each case on the top side and on the bottom side of an elevated ring portion and a recessed ring portion.

11. The brush ring as claimed in claim 1, wherein the connecting means have first positive locking means that are recessed and elevated in a wave-like manner in the axial direction and are provided in each case with second positive locking means that are arranged as a pin and a recess in the axial direction.

12. The brush ring as claimed in claim 1, wherein a plurality of the brush rings are stacked into one another in the axial direction, and wherein adjacent ones of the brush rings are aligned and rotated in an alternate manner about the center point axis and are connected in a non-rotatable manner by the connecting means.

13. The brush ring as claimed in claim 1, wherein the frame part, when viewed in the circumferential direction, has a continuously arched and alternately curved outer contour.

14. A sweeping roller having a substantially cylindrical shaft on which a plurality of the brush rings as claimed in claim 1 are mounted in a non-rotatable manner by means of a corresponding driving device and aligned with respect to one another in the axial direction.

* * * * *